US009943194B2

(12) United States Patent
Lightner et al.

(10) Patent No.: US 9,943,194 B2
(45) Date of Patent: Apr. 17, 2018

(54) SYSTEM AND METHOD FOR VARIABLE MATERIAL DOSING BASED ON A PERSON'S SIZE

(71) Applicant: GOJO Industries, Akron, OH (US)

(72) Inventors: Bradley Lee Lightner, SE Canton, OH (US); Mark Adam Bullock, Wooster, OH (US)

(73) Assignee: GOJO INDUSTRIES, INC., Akron, OH (US)

( * ) Notice: Subject to any disclaimer, the term of this patent is extended or adjusted under 35 U.S.C. 154(b) by 0 days.

(21) Appl. No.: 14/615,557

(22) Filed: Feb. 6, 2015

(65) Prior Publication Data

US 2015/0216370 A1 Aug. 6, 2015

Related U.S. Application Data

(60) Provisional application No. 61/936,546, filed on Feb. 6, 2014.

(51) Int. Cl.

| | |
|---|---|
| ***B05B 12/12*** | (2006.01) |
| ***A47K 5/12*** | (2006.01) |
| *B05C 15/00* | (2006.01) |

(52) U.S. Cl.

CPC ..... *A47K 5/1217* (2013.01); *B05B 12/122* (2013.01); *B05B 12/124* (2013.01); *B05C 15/00* (2013.01)

(58) Field of Classification Search

CPC .... A47K 5/1217; A61M 35/00; B05B 12/122; B05B 12/124; B05B 15/12; B05B 13/0436; B05B 13/0421; B05B 13/0405; B05C 15/00

See application file for complete search history.

(56) References Cited

U.S. PATENT DOCUMENTS

| | | | | |
|---|---|---|---|---|
| 9,386,889 | B2 * | 7/2016 | Fischer | A47K 3/28 |
| 9,480,994 | B2 * | 11/2016 | Shankar | E03C 1/084 |
| 2003/0094509 | A1 * | 5/2003 | Venuto, Sr. | A45D 44/00 239/200 |
| 2004/0073186 | A1 * | 4/2004 | Cameron | B05B 13/0431 604/389 |

(Continued)

FOREIGN PATENT DOCUMENTS

| | | | |
|---|---|---|---|
| EP | 2228774 | A2 | 9/2010 |
| WO | 03048005 | A1 | 6/2003 |

(Continued)

OTHER PUBLICATIONS

Int. Search Report cited in PCT Application No. PCT/US2015/014723 dated May 20, 2015, 11 pgs.

*Primary Examiner* — Frederick C Nicholas
(74) *Attorney, Agent, or Firm* — Calfee, Halter & Griswold LLP

(57) ABSTRACT

A dispensing system includes a dispensing device for dispensing a material stored within the dispensing device. The dispensing system includes a sensor assembly coupled to the dispensing device and for detecting a size of a user in proximity to the dispensing device. The sensor assembly can activate the dispensing device or provide information to the dispensing device to dispense a quantity of the material that is based on the size of the user detected by the sensor assembly. A method of dispensing a material is also provided.

20 Claims, 7 Drawing Sheets

(56) References Cited

U.S. PATENT DOCUMENTS

| | | | | |
|---|---|---|---|---|
| 2005/0086738 | A1* | 4/2005 | Gragtmans | A47K 3/288 4/622 |
| 2006/0032439 | A1* | 2/2006 | Burato | A61M 35/00 118/712 |
| 2006/0118039 | A1 | 6/2006 | Cooper | |
| 2006/0275555 | A1* | 12/2006 | Colizza | B05B 15/1214 427/458 |
| 2007/0107121 | A1* | 5/2007 | Smith | A61M 35/00 4/615 |
| 2007/0197982 | A1* | 8/2007 | Thomason | A61M 35/00 604/289 |
| 2009/0314857 | A1* | 12/2009 | Thomason | A61M 35/00 239/296 |
| 2010/0001097 | A1* | 1/2010 | Spivak | A61M 35/00 239/207 |
| 2010/0038448 | A1* | 2/2010 | Ghavami-Nasr | A61L 2/22 239/124 |
| 2010/0065655 | A1* | 3/2010 | Hipperson | A01K 13/001 239/99 |
| 2012/0249331 | A1* | 10/2012 | Wegelin | G06F 19/327 340/573.1 |
| 2013/0180449 | A1* | 7/2013 | Stafford-Nelson | A61M 35/00 118/696 |
| 2013/0200097 | A1* | 8/2013 | Yang | A47K 5/1217 222/52 |
| 2013/0283516 | A1* | 10/2013 | Fischer | A47K 3/28 4/535 |
| 2016/0309967 | A1* | 10/2016 | Pelfrey | A47K 5/1217 |

FOREIGN PATENT DOCUMENTS

| | | | |
|---|---|---|---|
| WO | 2004069322 | A1 | 8/2004 |
| WO | 20121007730 | A1 | 1/2012 |

* cited by examiner

SYSTEM AND METHOD FOR VARIABLE MATERIAL DOSING BASED ON A PERSON'S SIZE

CROSS-REFERENCE TO RELATED APPLICATIONS

This application claims priority to U.S. Provisional Patent Application No. 61/936,546, filed on Feb. 6, 2014, the entire disclosure of which is hereby incorporated by reference.

TECHNICAL FIELD

The instant application is generally directed towards a dispensing system. For example, the instant application is directed towards a sensor assembly for a dispensing system.

BACKGROUND

Dispensing systems can dispense a sanitizing material to a user. Dispensing systems can be used, for example, in schools, hospitals, nursing homes, factories, restaurants, etc.

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

In an example, a dispensing system comprises a dispensing device configured to dispense a material stored within the dispensing device. The dispensing system comprises a sensor assembly coupled to the dispensing device and configured to detect a size of a user in proximity to the dispensing device. The sensor assembly can activate the dispensing device to dispense a quantity of the material that is based on the size of the user detected by the sensor assembly.

In another example, a dispensing system comprises a dispensing device configured to dispense a material stored within the dispensing device. The dispensing system comprises a sensor assembly coupled to the dispensing device. The sensor assembly comprises a first sensor positioned at a first height, the sensor assembly configured to detect a first size of a user based upon an output from the first sensor. The sensor assembly comprises a second sensor positioned at a second height that is greater than the first height. The sensor assembly is configured to detect a second size of the user based upon the output from the first sensor and an output from the second sensor or a third size of the user based upon an output from the second sensor. The second size of the user is greater than or equal to the first size of the user and the third size of the user is greater than the second size of the user.

In another example, a method of dispensing a material comprises detecting a presence of a user in proximity to a dispensing system from which the material is dispensed. The method comprises detecting a size of the user in proximity to the dispensing system. The method comprises dispensing a quantity of the material from the dispensing system based on the size of the user.

The following description and annexed drawings set forth certain illustrative aspects and implementations. These are indicative of but a few of the various ways in which one or more aspects can be employed. Other aspects, advantages, and/or novel features of the disclosure will become apparent from the following detailed description when considered in conjunction with the annexed drawings.

DETAILED DESCRIPTION

Figure 1:
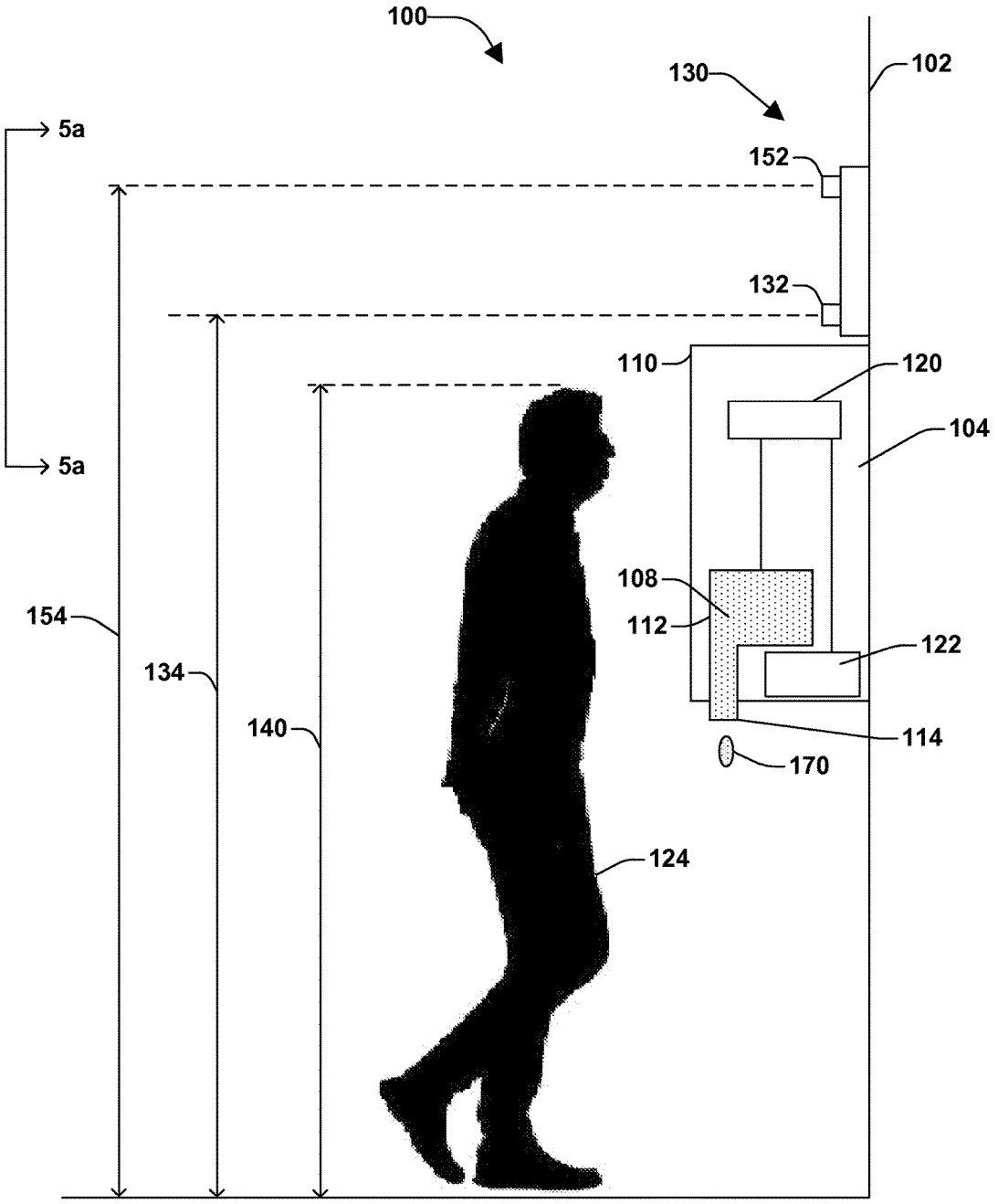
FIG. 1 is an illustration of an example dispensing system.

The claimed subject matter is now described with reference to the drawings, wherein like reference numerals are generally used to refer to like elements throughout. In the following description, for purposes of explanation, numerous specific details are set forth in order to provide an understanding of the claimed subject matter. It is evident, however, that the claimed subject matter can be practiced without these specific details. In other instances, structures and devices are illustrated in block diagram form in order to facilitate describing the claimed subject matter.

Turning to FIG. 1, a dispensing system 100 is illustrated. In general, the dispensing system 100 can be used for storing and/or dispensing a material. The dispensing system 100 can be attached, for example, to a surface 102 or nearly any type of surface. In some examples, the surface 102 may include, but is not limited to, walls, ceilings, support structures, or the like. The dispensing system 100 can be used in any number of environments, including hospitals, nursing homes, restaurants, schools, factories, warehouses, etc.

The dispensing system 100 can include a dispensing device 104. The dispensing device 104 can be attached to the surface 102. In an example, the dispensing device 104 dispenses a material 108 that is stored within the dispensing device 104. The dispensing device 104 can include a housing 110 that defines an interior in which the material 108 is stored. In one possible example, a container 112 is stored within the housing 110. The container 112 defines a substantially hollow interior in which the material 108 is stored. In some examples, the container 112 includes a nozzle 114 through which the material 108 can be selectively dispensed.

The material 108 includes any type of liquid, semi-liquid, gel, powder, foam based materials, etc. The material 108 can include, for example, cleaning materials such as disinfectants, sanitizers, antiseptics, soaps, moisturizers, or the like. In other examples, the material 108 may include water or other non-cleaning liquid materials. Indeed, the material 108 is not specifically limited to these examples, and could include any type of materials.

The dispensing system 100 can include a controller 120. The controller 120, which may include a logic controller (e.g., microcontroller, etc.) or the like, is coupled to the container 112. In an example, the controller 120 can control the dispensing of the material 108 from the container 112. In some examples, the dispensing system 100 includes a proximity sensor 122 that is coupled to the controller 120. The proximity sensor 122 can detect the presence of a user 124 in proximity to the dispensing system 100. The proximity sensor 122 can communicate with the controller 120 to cause the material 108 to be dispensed from the container 112 to the user 124.

The dispensing system 100 can include a sensor assembly 130. In an example, the sensor assembly 130 can be attached to and/or supported by the surface 102. The sensor assembly 130 can be coupled to the dispensing device 104. In some examples, the sensor assembly 130 can detect a size of the user 124 in proximity to the dispensing device 104. As such, the sensor assembly 130 can activate the dispensing device 104 to dispense a quantity of the material 108 that is based on the size of the user 124 detected by the sensor assembly 130.

The sensor assembly 130 can include a first sensor 132 positioned at a first height 134 (e.g., with heights being measured from the ground or floor). The first sensor 132 comprises any number of sensors, including active sensors, passive sensors, infrared sensors, parallel sensors, triangulated sensors, position sensitive devices, time of flight distance sensors, radio frequency signal strength, capacitive sensors, inductive sensors, microwave sensors, optical sensors, or the like. In some examples, the first sensor 132 comprises sonar, ultrasonic, or laser sensors. Indeed, the first sensor 132 can include nearly any type of sensor that can detect the presence of the user 124 without physical contact. In one possible example, the first sensor 132 may detect a temperature difference above a threshold difference from an ambient temperature based upon infrared radiation emitted from the user 124 standing in proximity to the first sensor 132.

The sensor assembly 130 can detect a first size 140 of the user based upon an output from the first sensor 132. In an example, when the user 124 has a size that is at least as great as the first height 134 of the first sensor 132, the first sensor 132 can detect the presence and/or size of the user 124. The first sensor 132 can detect the presence and/or size of the user 124 based on infrared radiation emitted from the user 124. In some examples, the user 124 has a first size 140 that may include a height of the user. In the illustrated example, the first size 140 is less than the first height 134 of the first sensor 132. As such, the first sensor 132 may not detect the user 124 or may detect that the first size 140 of the user 124 is less than the first height 134 of the first sensor 132. In these examples, an output from the first sensor 132 may be transmitted to the controller 120, with the output being indicative of the first size 140 of the user 124.

The sensor assembly 130 can include a second sensor 152 positioned at a second height 154 that is greater than the first height 134. The second sensor 152 comprises any number of sensors, including active sensors, passive sensors, infrared sensors, parallel sensors, triangulated sensors, position sensitive devices, time of flight distance sensors, radio frequency signal strength, capacitive sensors, inductive sensors, microwave sensors, optical sensors, or the like. In some examples, the second sensor 152 comprises sonar, ultrasonic, or laser sensors. Indeed, the second sensor 152 can include nearly any type of sensor that can detect the presence of the user 124 without physical contact. In one possible example, the second sensor 152 may detect a temperature difference above a threshold difference from an ambient temperature based upon infrared radiation emitted from the user 124 standing in proximity to the second sensor 152.

The sensor assembly 130 can detect a second size 156 (illustrated in FIG. 2) of the user based upon an output from the second sensor 152. In an example, when the user 124 has a size that is at least as great as the first height 134 of the first sensor 132 but less than the second height 154 of the second sensor 152, the second sensor 152 can detect the presence and/or size of the user 124. The second sensor 152 can detect the presence and/or size of the user 124 based on infrared radiation emitted from the user 124. In some examples, the second size 156 (illustrated in FIG. 2) of the user includes a height of the user. The second size 156 may be greater than the first height 134 of the first sensor 132 but less than the second height 154 of the second sensor 152. As such, in some examples, the second sensor 152 may not detect the user 124 or may detect that the second size 156 of the user 124 is less than the second height 154 of the second sensor 152. In these examples, an output from the second sensor 152 may be transmitted to the controller 120, with the output being indicative of the second size 156 of the user 124.

The sensor assembly 130 can detect a third size 160 (illustrated in FIG. 3) of the user based upon an output from the second sensor 152. In an example, when the user 124 has a size that is at least as great as the second height 154 of the second sensor 152, the second sensor 152 can detect the presence and/or size of the user 124. The second sensor 152 can detect the presence and/or size of the user 124 based on infrared radiation emitted from the user 124. In some examples, the third size 160 (illustrated in FIG. 3) of the user 124 may include a height of the user. The third size 160 may be greater than the second height 154 of the second sensor 152. As such, in some examples, the second sensor 152 may detect the user 124 and/or may detect that the third size 160 of the user 124 is greater than the second height 154 of the second sensor 152. In these examples, an output from the second sensor 152 may be transmitted to the controller 120, with the output being indicative of the third size 160 of the user 124.

In operation, the user 124 can approach the dispensing system 100. In an example, the dispensing system 100 can detect the presence of the user 124 in proximity to the dispensing device 104. In one possible example, the proximity sensor 122 can detect the user 124 and/or the user's hand(s). In the alternative, the sensor assembly 130 and/or other sensors can be provided to detect the user 124 in proximity to the dispensing device 104.

With the user 124 in proximity to the dispensing device 104, the sensor assembly 130 can detect the size (e.g., first size 140, second size 156, third size 160, etc.) of the user 124. In the illustrated example of FIG. 1, the user 124 includes the first size 140 that is less than the first height 134 of the first sensor 132 and the second height 154 of the second sensor 152. As such, neither of the first sensor 132 nor the second sensor 152 may detect the user 124. For example, neither of the first sensor 132 nor the second sensor 152 may detect infrared emissions from the user 124 since the first size 140 of the user is less than (e.g., below) the first height 134. In this example, an output from the first sensor 132 and the second sensor 152 may be transmitted to the controller 120, with the output being indicative of the first size 140 of the user 124.

Responsive to the size (e.g., first size 140) of the user 124, the dispensing device 104 can dispense a quantity of the material 108. The dispensing device 104 can dispense a quantity of the material 108 that is based on at least one of the first size 140 of the user 124, the second size 156 of the user 124 or the third size 160 of the user 124. In the illustrated example of FIG. 1, the quantity of the material 108 comprises a first quantity 170 of the material 108 for the first size 140 of the user 124. The controller 120 can control the container 112 and/or the nozzle 114 (e.g., by controlling a valve, pump, or the like) to cause the container 112 to dispense the first quantity 170 of the material 108. As such, the first quantity 170 of the material 108 is dispensed when the sensor assembly 130 (e.g., the first sensor 132) detects the first size 140 of the user 124.

Figure 2:
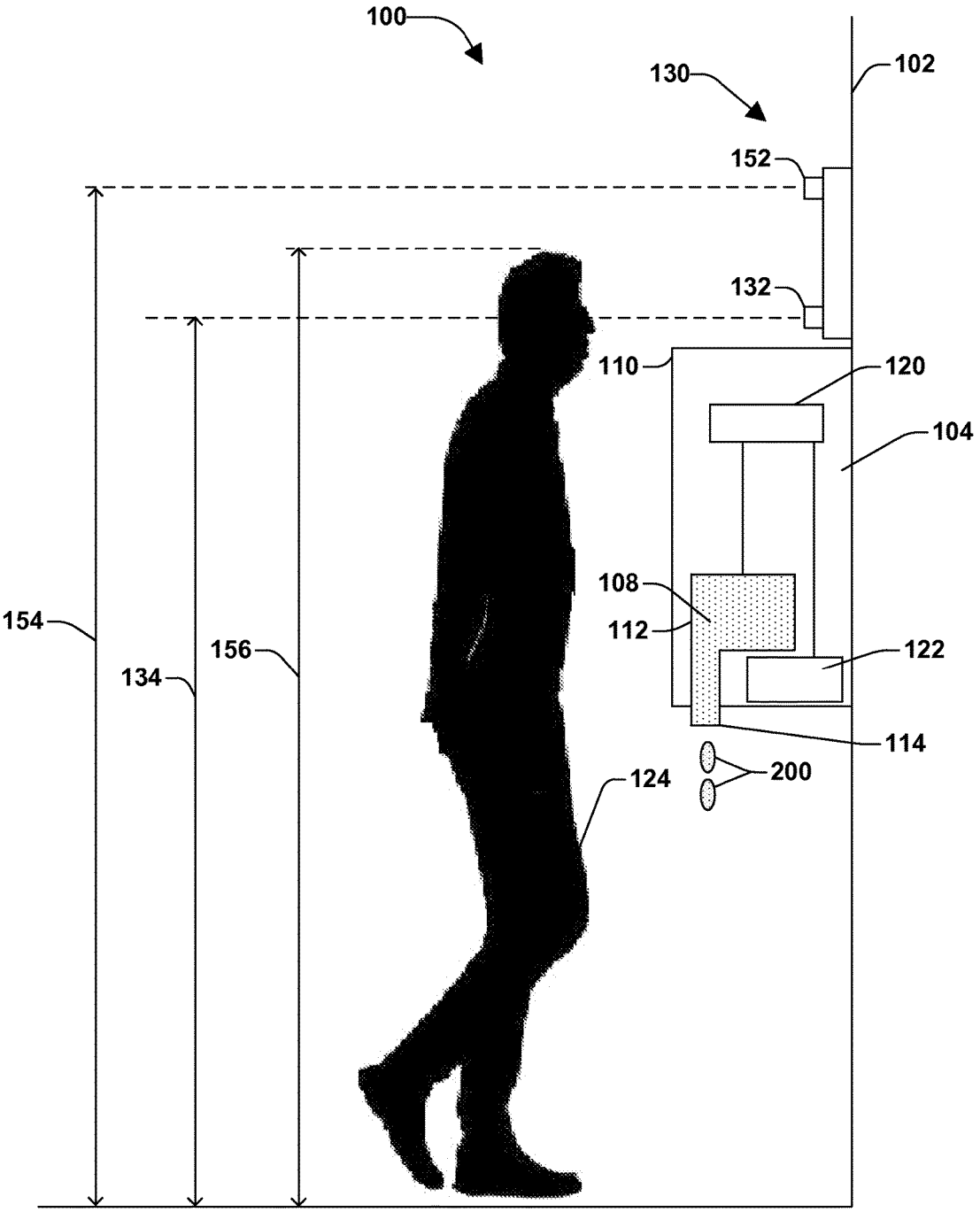
FIG. 2 is an illustration of an example dispensing system.

Turning to FIG. 2, the user 124, being of the second size 156, is illustrated in proximity to the dispensing device 104. The sensor assembly 130 can detect the size (e.g., first size 140, second size 156, third size 160, etc.) of the user 124. In the illustrated example, the user 124 includes the second size 156 that is greater than or equal to the first size 140 of the user 124. The second size 156 is greater than or equal to the first height 134 of the first sensor 132 but is less than the second height 154 of the second sensor 152. As such, the first sensor 132, but not the second sensor 152, may detect the user 124. In this example, the first sensor 132 can detect the user 124 based on infrared radiation emitted from the user 124. An output from the first sensor 132 and the second sensor 152 may be transmitted to the controller 120, with the output being indicative of the second size 156 of the user 124.

Responsive to the size (e.g., second size 156) of the user 124, the dispensing device 104 can dispense a quantity of the material 108. The dispensing device 104 can dispense a quantity of the material 108 that is based on the second size 156 of the user 124. In the illustrated example, the quantity of the material 108 comprises a second quantity 200 of the material 108 for the second size 156 of the user 124. The second quantity 200 of the material 108 is greater than or equal to the first quantity 170 of the material 108. The controller 120 can control the container 112 and/or the nozzle 114 (e.g., by controlling a valve, pump, or the like) to cause the container 112 to dispense the second quantity 200 of the material 108. As such, the second quantity 200 of the material 108 is dispensed when the sensor assembly 130 (e.g., the first sensor 132) detects the second size 156 of the user 124.

Figure 3:
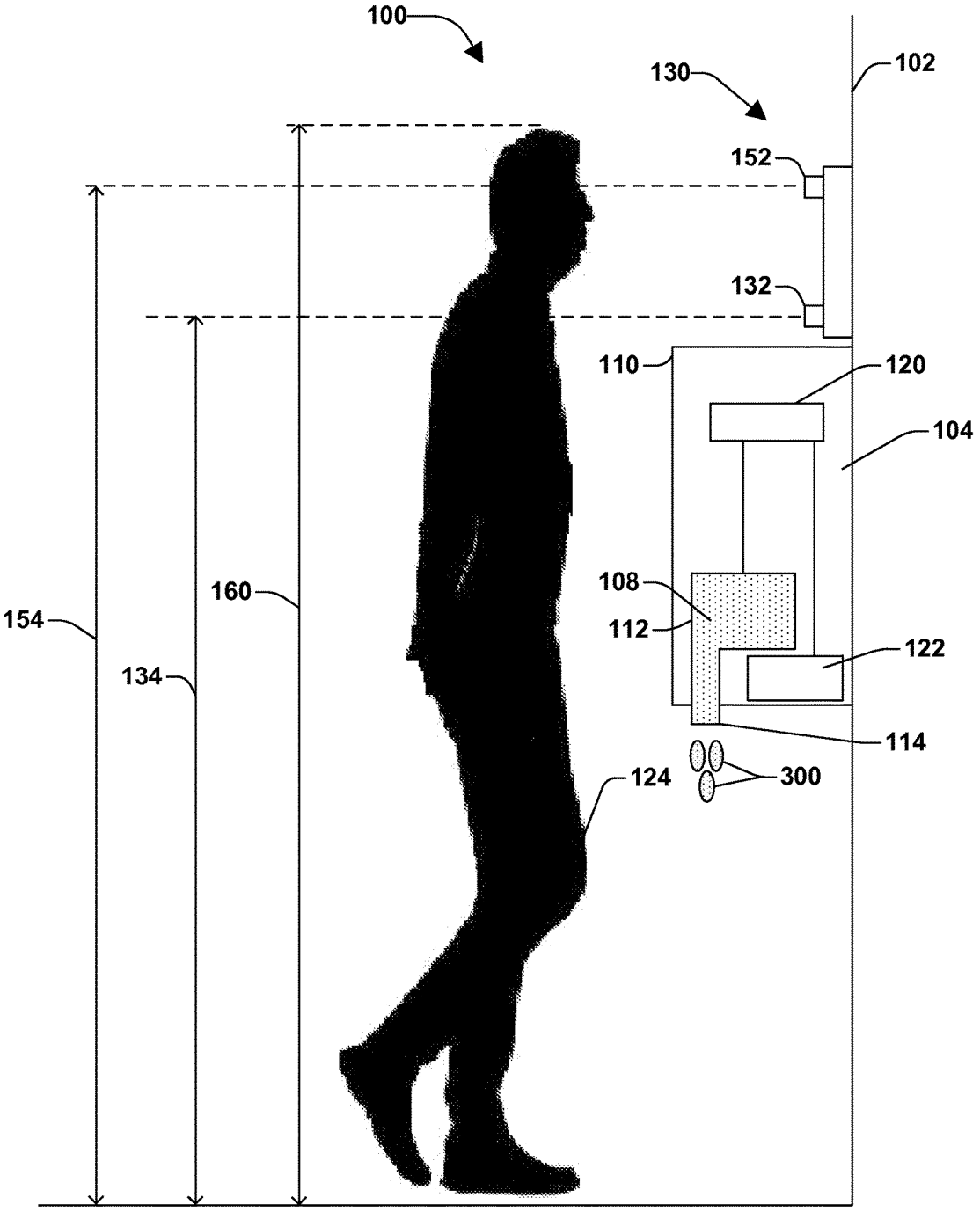
FIG. 3 is an illustration of an example dispensing system.

Turning to FIG. 3, the user 124, being of the third size 160, is illustrated in proximity to the dispensing device 104. The sensor assembly 130 can detect the size (e.g., first size 140, second size 156, third size 160, etc.) of the user 124. In the illustrated example, the user 124 includes the third size 160 that is greater than or equal to the second size 156 of the user 124. The third size 160 of the user 124 may also be greater than or equal to the second height 154 of the second sensor 152. As such, the first sensor 132 and the second sensor 152 may detect the user 124. In this example, the first sensor 132 and the second sensor 152 can detect the user 124 based on infrared radiation emitted from the user 124. An output from the first sensor 132 and the second sensor 152 may be transmitted to the controller 120, with the output being indicative of the third size 160 of the user 124.

Responsive to the size (e.g., third size 160) of the user 124, the dispensing device 104 can dispense a quantity of the material 108. The dispensing device 104 can dispense a quantity of the material 108 that is based on the third size 160 of the user 124. In the illustrated example, the quantity of the material 108 comprises a third quantity 300 of the material 108 for the third size 160 of the user 124. The third quantity 300 of the material 108 may be greater than or equal to the second quantity 200 of the material 108. The controller 120 can control the container 112 and/or the nozzle 114 (e.g., by controlling a valve, pump, or the like) to cause the container 112 to dispense the third quantity 300 of the material 108. As such, the third quantity 200 of the material 108 is dispensed when the sensor assembly 130 (e.g., the first sensor 132 and the second sensor 152) detects the third size 160 of the user 124.

Figure 4:
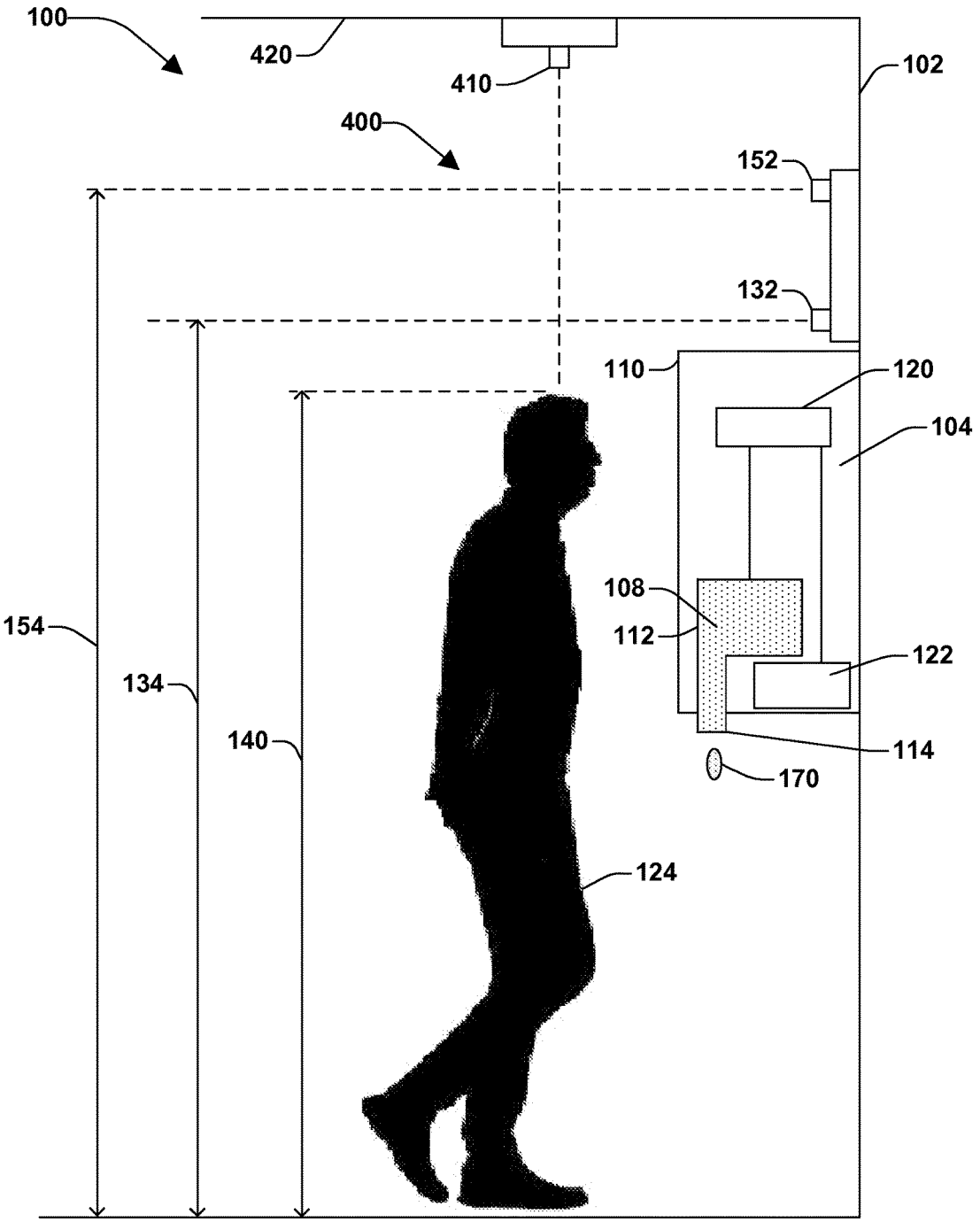
FIG. 4 is an illustration of an example dispensing system.

Turning to FIG. 4, the dispensing system 100 is illustrated along with the dispensing device 104. In this example, the dispensing system 100 comprises a second example sensor assembly 400. The second sensor assembly 400 includes the first sensor 132 and second sensor 152 attached to the surface 102 and coupled to the dispensing device 104. The first sensor 132 and second sensor 152 are structurally and functionally identical to the first sensor 132 and second sensor 152 described above with respect to the sensor assembly 130 of FIGS. 1 to 3.

In addition to the first sensor 132 and second sensor 152, the second sensor assembly 400 can include a third sensor 410. In the illustrated example, the third sensor 410 is attached to/supported by a second surface (e.g., a ceiling 420). The third sensor 410 is not limited to being attached to/supported by the second surface (e.g., ceiling 420), and in other examples, could be located on a vertically extending surface that is adjacent the surface 102. The third sensor 410 can be positioned over an area in which the user 124 is located when the user 124 is in proximity to the dispensing device 104.

The third sensor 410 comprises any number of sensors, including active sensors, passive sensors, infrared sensors, parallel sensors, triangulated sensors, position sensitive devices, time of flight distance sensors, radio frequency signal strength, capacitive sensors, inductive sensors, microwave sensors, optical sensors, or the like. In some examples, the third sensor 410 comprises sonar, ultrasonic, or laser sensors. Indeed, the third sensor 410 can include nearly any type of sensor that can detect the presence of the user 124 without physical contact. In one possible example, the third sensor 410 may detect a temperature difference above a threshold difference from an ambient temperature based upon infrared radiation emitted from the user 124 standing in proximity to the third sensor 410.

While the third sensor 410 is illustrated in conjunction with the first sensor 132 and second sensor 152, in some examples, the third sensor 410 may operate independently and/or without the first sensor 132 and/or second sensor 152. In such an example, the third sensor 410 may be provided without the first sensor 132 and/or the second sensor 152. As such, the third sensor 410 can detect the presence of the user 124 and the size of the user 124, and communicate this information to the dispensing device 104.

In the example of FIG. 4, the third sensor 410 can detect when the user 124 is in proximity to the dispensing device 104. For example, when the user 124 is in proximity to the dispensing device 104, the third sensor 410 may detect the temperature difference above a threshold difference from an ambient temperature based upon infrared radiation emitted from the user 124. An output from the third sensor 410 may be transmitted to the controller 120, with the output indicating that the user 124 is in proximity to the dispensing device 104. The third sensor 410 can be used in addition to or as an alternative to the proximity sensor 122 within the dispensing device 104.

In operation, the user 124 can approach the dispensing system 100. In an example, the third sensor 410 can detect the presence of the user 124 in proximity to the dispensing device 104 such as by sensing infrared radiation emitted from the user 124. An output from the third sensor 410 may be transmitted to the controller 120 indicating that the user 124 is in proximity to the dispensing device 104. Next, in a similar manner as described above in FIGS. 1 to 3, the second sensor assembly 400, including the first sensor 132 and second sensor 152, can detect a size (e.g., first size 140, second size 156, third size 160, etc.) of the user 124 based upon the output from the first sensor 132 and/or the output from the second sensor 152.

Figure 5A:
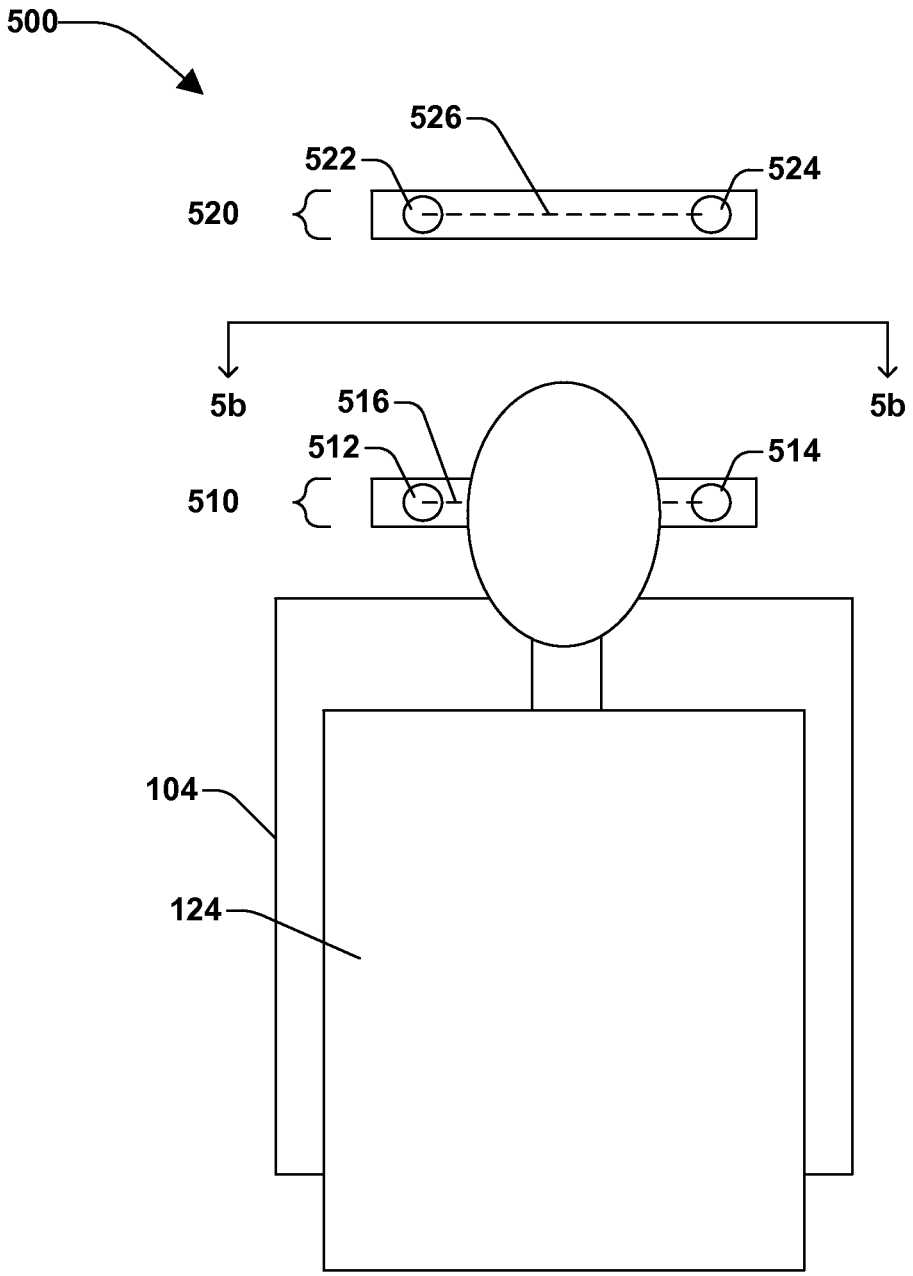
FIG. 5A is an illustration of an example dispensing system.

Turning to FIG. 5A, an example of a third sensor assembly 500 along lines 5A-5A of FIG. 1 is illustrated. In this example, the third sensor assembly 500 comprises a first sensor 510 and a second sensor 520. As with the previous examples, the third sensor assembly 500, including the first sensor 510 and second sensor 520, is attached to/supported by the surface 102 and may be coupled to the dispensing device 104.

In an example, the first sensor 510 comprises a first sensing device 512 and a second sensing device 514. The first sensing device 512 and second sensing device 514 are positioned along a first sensor axis 516 that is horizontal. In one possible example, the first sensing device 512 comprises an emitter that can send out one or more signals. The one or more signals sent out by the first sensing device 512 can include, for example, photons, light pulses, parallel beams, triangulated beams, lasers or the like. These signals can reflect off the user 124. The second sensing device 514 is positioned in proximity to and adjacent to the first sensing device 512. In one possible example, the second sensing device 514 comprises a receiver, such as a photodiode, array of photodiodes, time of flight measurement device, etc. The second sensing device 514 can detect/receive the signals sent out by the first sensing device 512.

The second sensor 520 comprises a first sensing device 522 and a second sensing device 524. The second sensor 520 is identical to the first sensor 510. The first sensing device 522 and second sensing device 524 are positioned along a second sensor axis 526 that is horizontal. In an example, the second sensor axis 526 is parallel with respect to the first sensor axis 516, with the second sensor axis 526 spaced a distance apart (e.g., above) from the first sensor axis 516. In one possible example, the first sensing device 522 comprises an emitter that can send out one or more signals. The one or more signals sent out by the first sensing device 522 can include, for example, photons, light pulses, parallel beams, triangulated beams, lasers or the like. These signals can reflect off the user 124. The second sensing device 524 is positioned in proximity to and adjacent to the first sensing device 522. In one possible example, the second sensing device 524 comprises a receiver, such as a photodiode, array of photodiodes, time of flight measurement device, etc. The second sensing device 524 can detect/receive the signals sent out by the first sensing device 522.

Figure 5B:
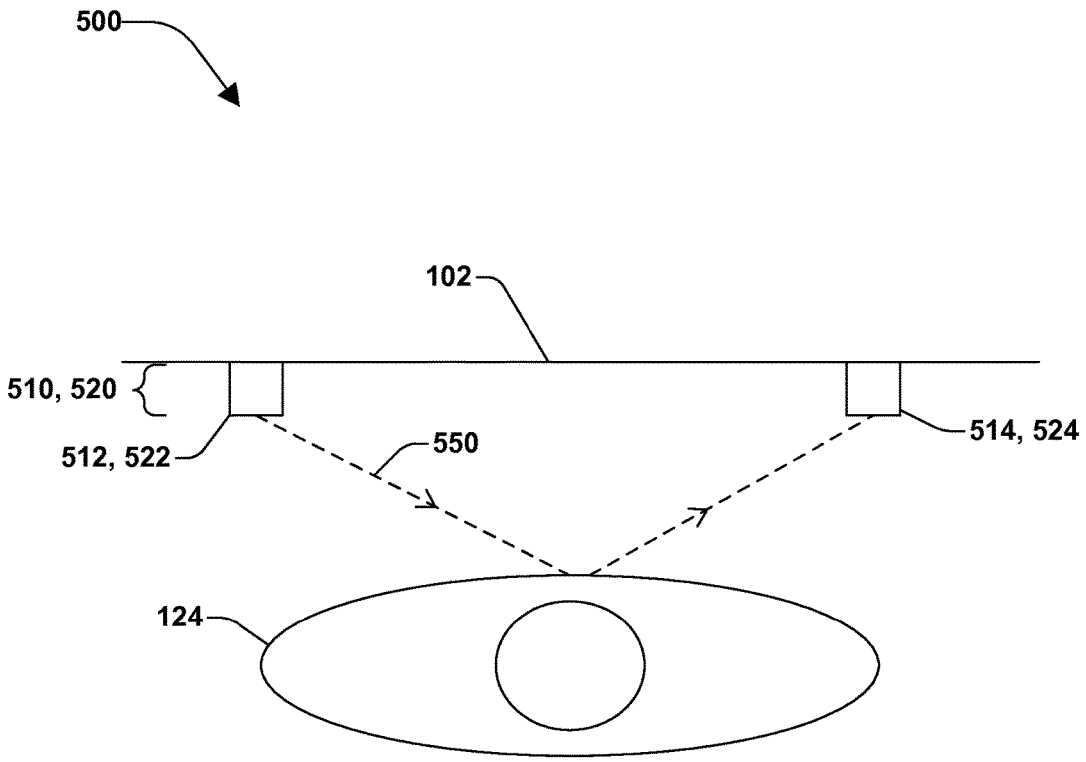
FIG. 5B is an illustration of an example dispensing system.

FIG. 5B illustrates an example operation of the third sensor assembly 500 along lines 5B-5B of FIG. 5A. In this example, the illustrated sensor (e.g., first sensing device and second sensing device) comprises either of the first sensor 510 (e.g., the first sensing device 512 and second sensing device 514) or the second sensor 520 (e.g., the first sensing device 522 and second sensing device 524).

In operation, the first sensing device 512, 522 can send out one or more signals 550. The signals 550 may be directed towards the user 124, who is standing in proximity to the dispensing device 104. In some examples, the signals 550 are reflected off of the user 124 and detected by the second sensing device 514, 524. An output from the second sensing device 514, 524 of the first sensor 510 or second sensor 520 may be transmitted to the controller 120. In some examples, this output can indicate that the user 124 is in proximity to the dispensing device 104. In another example, this output can indicate the size (e.g., first size 140, second size 156, third size 160, etc.) of the user 124. In yet another example, this output can indicate the distance that the user 124 is away from the dispensing device 104. For example, based on time of flight (e.g., time between transmission of signals from first sensing device 512, 522 to second sensing device 514, 524), signal strength (e.g., signal strength received by second sensing device 514, 524), or the like, the distance of the user 124 from the dispensing device 104 can be determined.

In some examples, the third sensor assembly 500 can detect the size of the user 124 without inadvertently detecting the size of a person or object located behind or adjacent the user 124. For example, the first sensor 510 and/or second sensor 520 can detect the size of the user 124. Based on factors related to the signals 550 emitted by the first sensing device 512, 522 and received by the second sensing device 514, 524, the third sensor assembly 500 can determine the size of the user 124 while ignoring, filtering, and/or not detecting the size of people/objects adjacent the user 124. In an example, factors related to the signals 550 can include the strength of the signal 550 received by the second sensing device 514, 524, time of flight between emission and reception of the signals 550, or the like. In such an example, signals that are stronger and/or faster may be indicative of the user 124 and not other people/objects adjacent the user 124. In one possible example, the third sensor assembly 500 can output this information to the controller 120, such that the dispensing device 104 can dispense the quantity of the material 108 that is based on the size of the user 124.

Figure 6:
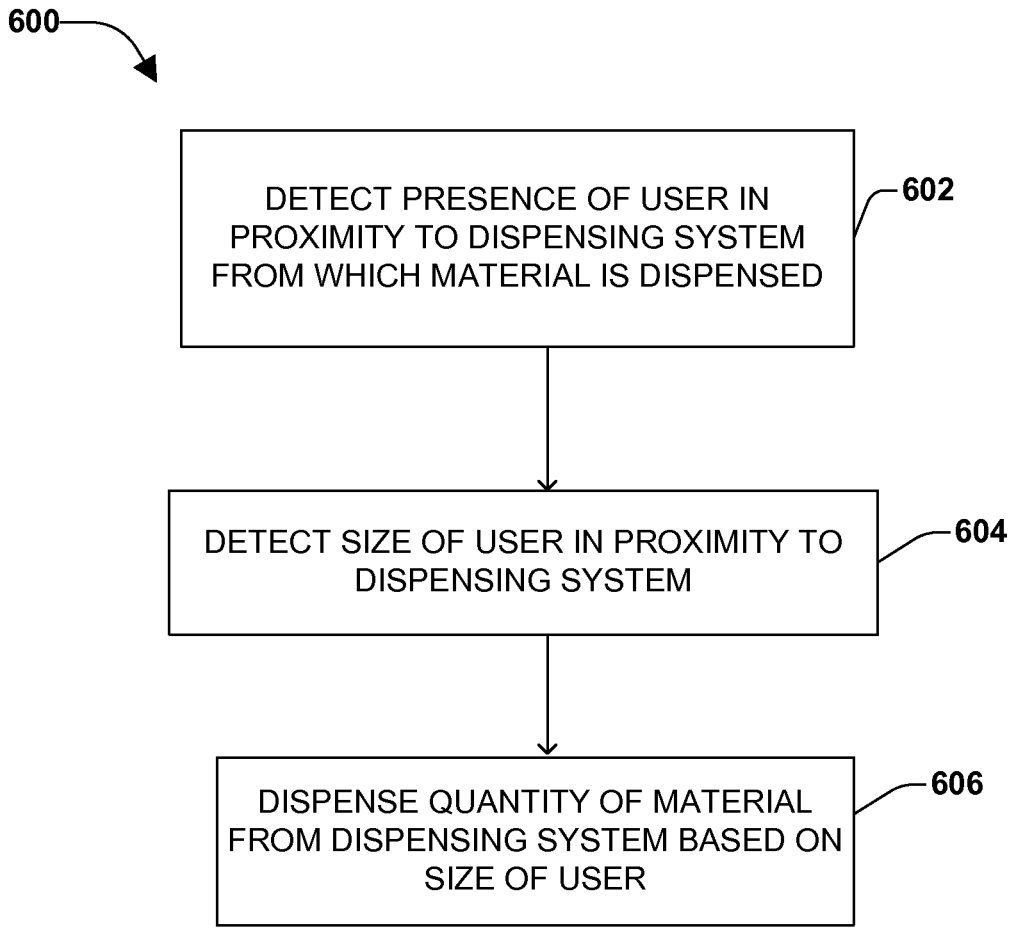
FIG. 6 is an illustration of an example method of dispensing a material.

Turning to FIG. 6, an example method 600 for dispensing the material 108 is illustrated. The method 600 can be used in association with some or all of the features illustrated in FIGS. 1 to 5. At 602, the method 600 includes detecting the presence of the user 124 in proximity to the dispensing system 100 from which the material 108 is dispensed. At 604, the method 600 includes detecting the size of the user 124 in proximity to the dispensing system 100. At 606, the method 600 includes dispensing a quantity of the material from the dispensing system 100 based on the size of the user 124.

Although the subject matter has been described in language specific to structural features or methodological acts, it is to be understood that the subject matter defined in the appended claims is not necessarily limited to the specific features or acts described above. Rather, the specific features and acts described above are disclosed as example forms of implementing at least some of the claims.

Various operations of embodiments are provided herein. The order in which some or all of the operations described should not be construed to imply that these operations are necessarily order dependent. Alternative ordering will be appreciated having the benefit of this description. Further, it will be understood that not all operations are necessarily present in each embodiment provided herein. Also, it will be understood that not all operations are necessary in some embodiments.

Many modifications may be made to the instant disclosure without departing from the scope or spirit of the claimed subject matter. Unless specified otherwise, "first," "second," or the like are not intended to imply a temporal aspect, a spatial aspect, an ordering, etc. Rather, such terms are merely used as identifiers, names, etc. for features, elements, items, etc. For example, a first end and a second end generally correspond to end A and end B or two different or two identical ends or the same end.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application are generally to be construed to mean "one or more" unless specified otherwise or clear from context to be directed to a singular form. Also, at least one of A and B or the like generally means A or B or both A and B. Furthermore, to the extent that "includes", "having", "has", "with", or variants thereof are used in either the detailed description or the claims, such terms are intended to be inclusive in a manner similar to "comprising".

Also, although the disclosure has been illustrated and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A soap or sanitizer dispensing system comprising:

a dispensing device configured to dispense a quantity of a material stored within the dispensing device;

a proximity sensor for detecting a hand of a user in proximity to the dispensing device, wherein the proximity sensor is configured to activate the dispensing device to dispense the quantity of the material upon detecting the hand of the user;

a sensor assembly coupled to the dispensing device and configured to detect a size of the user in proximity to the dispensing device, wherein the quantity of the material that is dispensed from the dispensing device is based on the size of the user detected by the sensor assembly.

2. The dispensing system of claim 1, wherein the sensor assembly comprises a first sensor positioned at a first height.

3. The dispensing system of claim 2, wherein the sensor assembly is configured to detect a first size of the user based upon an output from the first sensor.

4. The dispensing system of claim 3, wherein the sensor assembly comprises a second sensor positioned at a second height that is greater than the first height, wherein the sensor assembly is configured to detect:

a second size of the user based upon the output from the first sensor and an output from the second sensor, or a third size of the user based upon an output from the second sensor, wherein the second size of the user is greater than or equal to the first size of the user, and wherein the third size of the user is greater than the second size of the user.

5. The dispensing system of claim 4, wherein the quantity of the material comprises a first quantity of the material for the first size of the user, a second quantity of the material for the second size of the user and a third quantity of the material for the third size of the user.

6. The dispensing system of claim 5, wherein the second quantity of the material is greater than or equal to the first quantity of the material.

7. The dispensing system of claim 6, wherein the third quantity of the material is greater than the second quantity of the material.

8. The dispensing system of claim 1, wherein the material comprises a disinfectant.

9. The dispensing system of claim 1, wherein the size of the user comprises a height.

10. A dispensing system comprising:

a dispensing device configured to dispense a material stored within the dispensing device; and a sensor assembly coupled to the dispensing device, the sensor assembly comprising:

a first sensor positioned at a first height, wherein the sensor assembly is configured to detect a first size of a user based upon an output from the first sensor; and a second sensor positioned at a second height that is greater than the first height, wherein the sensor assembly is configured to detect:

a second size of the user based upon the output from the first sensor and an output from the second sensor, or a third size of the user based upon an output from the second sensor, wherein the second size of the user is greater than or equal to the first size of the user, and wherein the third size of the user is greater than the second size of the user.

11. The dispensing system of claim 10, wherein the sensor assembly is configured to activate the dispensing device to dispense a quantity of the material, wherein the quantity of the material comprises a first quantity of the material for the first size of the user, a second quantity of the material for the second size of the user and a third quantity of the material for the third size of the user.

12. The dispensing system of claim 11, wherein the second quantity of the material is greater than or equal to the first quantity of the material.

13. The dispensing system of claim 12, wherein the third quantity of the material is greater than the second quantity of the material.

14. The dispensing system of claim 10, wherein the material comprises a disinfectant.

15. The dispensing system of claim 10, wherein the size of the user comprises a height.

16. The dispensing system of claim 10, wherein the sensor assembly comprises a third sensor configured to detect a presence of the user in proximity to the dispensing system.

17. A method of dispensing a soap or sanitizer material from a dispensing system, the dispensing system comprising a dispensing device for storing the material and dispensing the material, a proximity sensor for activating the dispensing device, and a sensor assembly coupled to the dispensing device, the method comprising:

detecting a hand of a user in proximity to the dispensing device using the proximity sensor;

detecting a size of the user in proximity to the dispensing device using the sensor assembly; and dispensing a quantity of the material from the dispensing device, wherein the quantity of the material is dispensed upon the proximity sensor detecting the hand of the user and activating the dispensing device to dispense the quantity of the material, and wherein the quantity of the material is based on the size of the user detected by the sensor assembly.

18. The method of claim 17, wherein the detecting the size of the user comprises detecting at least one of a first size of the user, a second size of the user, and a third size of the user.

19. The method of claim 18, wherein the detecting the size of the user comprises detecting the first size of the user, the second size of the user, and the third size of the user, and wherein the second size of the user is greater than or equal to the first size of the user, and wherein the third size of the user is greater than the second size of the user.

20. The method of claim 17, wherein the dispensing the quantity of the material comprises dispensing a first quantity of the material for a first size of a user, a second quantity of the material for a second size of the user, or a third quantity of the material for a third size of the user, wherein the second quantity of the material is greater than or equal to the first quantity of the material, and wherein the third quantity of the material is greater than the second quantity of the material.

* * * * *